US007520459B2

(12) United States Patent
O'Leary

(10) Patent No.: US 7,520,459 B2
(45) Date of Patent: Apr. 21, 2009

(54) BLOWING WOOL MACHINE WITH RAM TO PUSH WOOL

(75) Inventor: Robert J. O'Leary, Newark, OH (US)

(73) Assignee: Owens Corning Intellectual Capital, LLCDE (US)

( * ) Notice: Subject to any disclaimer, the term of this patent is extended or adjusted under 35 U.S.C. 154(b) by 723 days.

(21) Appl. No.: 11/312,883

(22) Filed: Dec. 20, 2005

(65) Prior Publication Data

US 2006/0147660 A1 Jul. 6, 2006

Related U.S. Application Data

(63) Continuation-in-part of application No. 11/024,093, filed on Dec. 28, 2004, now abandoned, and a continuation-in-part of application No. 10/899,909, filed on Jul. 27, 2004.

(51) Int. Cl.
*B02C 23/02* (2006.01)

(52) U.S. Cl. ..... 241/282; 241/60; 100/215

(58) Field of Classification Search ..... 241/34, 241/60, 282; 100/215
See application file for complete search history.

(56) References Cited

U.S. PATENT DOCUMENTS

| | | | | |
|---|---|---|---|---|
| 1,718,507 | A | 6/1929 | Wenzel et al. | |
| 2,193,849 | A | 3/1940 | Whitfield | |
| 2,200,713 | A | 5/1940 | Ericson et al. | |
| 2,235,542 | A | 3/1941 | Wenzel | |
| 2,262,094 | A | 11/1941 | Burt | |
| 2,311,773 | A | 2/1943 | Patterson | |
| 2,355,358 | A | 8/1944 | Anderson | |
| 2,437,831 | A | 3/1948 | Moore | |
| 2,532,318 | A | 12/1950 | Mackey et al. | |
| 2,532,351 | A | 12/1950 | Wedebrock | |
| 2,618,817 | A | 11/1952 | Slayter | |
| 4,236,654 | A | 12/1980 | Mello | |
| 4,273,296 | A | 6/1981 | Hoshall | |
| 4,344,580 | A | 8/1982 | Hoshall et al. | |
| 4,365,762 | A | 12/1982 | Hoshall | |
| 4,465,239 | A | 8/1984 | Woten | |
| 4,560,307 | A | 12/1985 | Deitesfeld | |
| 5,511,730 | A | 4/1996 | Miller et al. | |
| 5,639,033 | A | 6/1997 | Miller et al. | |
| 5,829,649 | A | 11/1998 | Horton | |
| 6,109,488 | A | 8/2000 | Horton | |
| 6,503,026 | B1 | 1/2003 | Mitchell | |
| 6,796,748 | B1 | 9/2004 | Sperber | |
| 7,284,715 | B2 * | 10/2007 | Dziesinski et al. | 241/36 |
| 2004/0124262 | A1 | 7/2004 | Bowman et al. | |

* cited by examiner

*Primary Examiner*—Jimmy T Nguyen
(74) *Attorney, Agent, or Firm*—James J. Dottavio; Jason S. Fokens

(57) ABSTRACT

A machine for distributing blowing wool from a bag of compressed blowing wool includes a chute having an inlet end and an outlet end, the chute being configured to receive the bag of compressed blowing wool. A ram assembly has a ram member configured to drive the compressed blowing wool from the bag toward the outlet end of the chute while maintaining the bag in a relatively fixed position with respect to the chute. A shredder is mounted at the outlet end of the chute and configured to pick apart the compressed blowing wool. A rotary valve distributes the blowing wool into an airstream.

9 Claims, 5 Drawing Sheets

BLOWING WOOL MACHINE WITH RAM TO PUSH WOOL

RELATED APPLICATIONS

This application is a Continuation-In-Part application of U.S. patent application Ser. No. 11/024,093, filed Dec. 28, 2004, now pending, and entitled METHOD FOR OPENING PACKAGES OF LOOSEFIL INSULATION MATERIAL, all of which is incorporated in the present application in its entirety. application Ser. No. 11/024,093 is a Continuation-In-Part application of U.S. patent application Ser. No. 10/899,909, filed Jul. 27, 2004, now pending, and entitled BLOWING MACHINE FOR LOOSEFIL INSULATION MATERIAL, all of which is incorporated in the present application in its entirety.

TECHNICAL FIELD

This invention relates to loosefil insulation for insulating buildings. More particularly this invention relates to distributing loosefil insulation packaged in a bag.

BACKGROUND OF THE INVENTION

In the insulation of buildings, a frequently used insulation product is loosefil insulation. In contrast to the unitary or monolithic structure in insulation batts or blankets, loosefil insulation is a multiplicity of discrete, individual tufts, cubes, flakes or nodules. Loosefil insulation is usually applied to buildings by blowing the insulation into an insulation cavity, such as a wall cavity or an attic of a building. Typically loosefil insulation is made of glass fibers although other mineral fibers, organic fibers, and cellulose fibers can be used.

Loosfil insulation, commonly referred to as blowing wool, is typically compressed and packaged in bags for transport from an insulation manufacturing site to a building that is to be insulated. Typically the bags are made of polypropylene or other suitable material. During the packaging of the blowing wool, it is placed under compression for storage and transportation efficiencies. Typically, the blowing wool is packaged with a compression ratio of at least 5:1. The distribution of blowing wool into an insulation cavity typically uses a blowing wool distribution machine that feeds the blowing wool pneumatically through a distribution hose. Blowing wool distribution machines typically have a large chute or hopper for containing and feeding the blowing wool after the bag is opened and the blowing wool is allowed to expand.

It would be advantageous if blowing wool machines could be improved to make them easier to use and transport.

SUMMARY OF THE INVENTION

A machine for distributing blowing wool from a bag of compressed blowing wool includes a chute having an inlet end and an outlet end, the chute being configured to receive the bag of compressed blowing wool. A ram assembly has a ram member configured to drive the compressed blowing wool from the bag toward the outlet end of the chute while maintaining the bag in a relatively fixed position with respect to the chute. A shredder is mounted at the outlet end of the chute and configured to pick apart the compressed blowing wool. A rotary valve distributes the blowing wool into an airstream.

According to this invention there is also provided a machine for distributing blowing wool from a bag of compressed blowing wool, with the machine including an upper unit and a chute. The chute includes an inlet end and an outlet end, and the chute is pivotally mounted in the upper unit and configured to pivot to an open position to receive the bag of compressed blowing wool and subsequently to pivot to a closed position. A ram assembly includes a ram member configured to drive the compressed blowing wool from the bag toward the outlet end of the chute while maintaining the bag in a relatively fixed position with respect to the chute. A shredder is mounted at the outlet end of the chute and configured to pick apart the compressed blowing wool. A rotary valve is provided for distributing the blowing wool into an airstream. The chute is configured such that in its closed position the chute is aligned with the ram assembly.

According to this invention there is also provided a machine for distributing blowing wool from a bag of compressed blowing wool. The machine includes a chute having an inlet end and an outlet end, the chute being configured to receive the bag of compressed blowing wool. A ram assembly includes a carriage and ram member positioned to drive the compressed blowing wool from the bag toward the outlet end of the chute while maintaining the bag in a relatively fixed position with respect to the chute. A slot in the chute extends from the inlet end of the chute and is configured to guide the carriage and the ram member to drive the compressed blowing wool from the bag toward the outlet. A shredder is mounted at the outlet end of the chute and is configured to pick apart the compressed blowing wool. A rotary valve for distributing the blowing wool into an airstream is provided.

According to this invention there is also provided machine for distributing blowing wool from a bag of compressed blowing wool. The machine has a chute including an inlet end and an outlet end, the chute being configured to receive the bag of compressed blowing wool. A ram assembly is configured to drive the compressed blowing wool from the bag toward the outlet end of the chute while maintaining the bag in a relatively fixed position with respect to the chute. The ram assembly further includes a ram member configured to contact the compressed blowing wool and to drive the compressed blowing wool through the bag, a ram mover configured to move the ram member to contact the compressed blowing wool and drive the compressed blowing wool through the bag, and a carriage connecting the ram member to the ram mover and mounted for movement along the chute.

According to this invention there is also provided a machine for distributing blowing wool from a bag of compressed blowing wool, where the machine has a chute including an inlet end and an outlet end, the chute being configured to receive the bag of compressed blowing wool. A ram assembly is configured to drive the compressed blowing wool from the bag toward the outlet end of the chute while maintaining the bag in a relatively fixed position with respect to the chute. The ram assembly further includes a ram member configured to contact the compressed blowing wool and to drive the compressed blowing wool through the bag. A ram mover is configured to move the ram member to contact the compressed blowing wool and drive the compressed blowing wool through the bag. A sensor is connected to the ram member and configured to determine the force of the ram member against the compressed blowing wool. A controller is connected to the sensor and configured to control the ram assembly in response to the sensor. A shredder is mounted at the outlet end of the chute and configured to pick apart the compressed blowing wool.

According to this invention there is also provided a machine for distributing blowing wool from a bag of compressed blowing wool, where the machine includes a chute including an inlet end and an outlet end, the chute being configured to receive the bag of compressed blowing wool. A ram assembly is configured to drive the compressed blowing wool from the bag toward the outlet end of the chute while maintaining the bag in a relatively fixed position with respect to the chute. A shredder is mounted at the outlet end of the chute and configured to pick apart the compressed blowing wool. A sensor is configured to determine the pressure of the blowing wool at a location downstream of the shredder. A controller is connected to the sensor and configured to control the ram assembly in response to the sensor.

According to this invention there is also provided a bag of compressed blowing wool comprising a body of compressed blowing wool, a bag encapsulating the body of compressed blowing wool and configured with tear away end portions enabling the ends of the bag to be readily removed from the bag, and a seam running substantially the length of the bag, the seam being configured to enable the bag to be readily opened by hand.

According to this invention there is also provided a bag of compressed blowing wool comprising a body of compressed blowing wool, a bag encapsulating the body of compressed blowing wool and configured with a high coefficient of friction on its outer surface, the bag being suitable for use in an apparatus having a chute and a ram assembly to drive the compressed blowing wool from the bag toward an outlet end of the chute while maintaining the bag in a relatively fixed position with respect to the chute.

According to this invention there is also provided a bag of compressed blowing wool comprising a body of compressed blowing wool, and a bag encapsulating the body of compressed blowing wool and configured with a gripping fixture on its outer surface, the bag being suitable for use in an apparatus having a chute and a ram assembly to drive the compressed blowing wool from the bag toward an outlet end of the chute while maintaining the bag in a relatively fixed position with respect to the chute.

Various objects and advantages of this invention will become apparent to those skilled in the art from the following detailed description of the preferred embodiment, when read in light of the accompanying drawings.

DETAILED DESCRIPTION OF THE INVENTION

Figure 3:
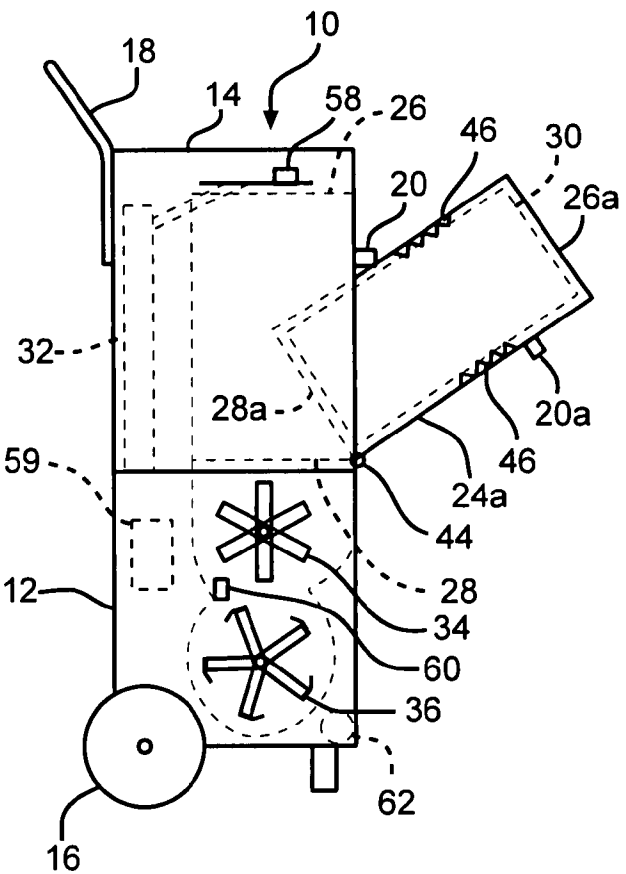
FIG. 3 is a side view in elevation, partially in cross-section, of the insulation blowing wool machine of FIG. 1 showing the open chute position.
Figure 2:
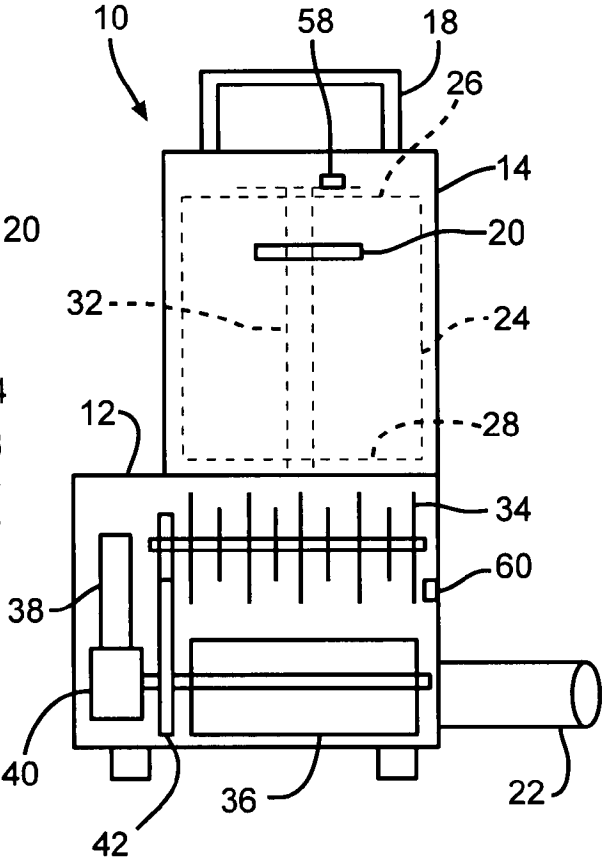
FIG. 2 is a front view in elevation, partially in cross-section, of the insulation blowing wool machine of FIG. 1.
Figure 1:
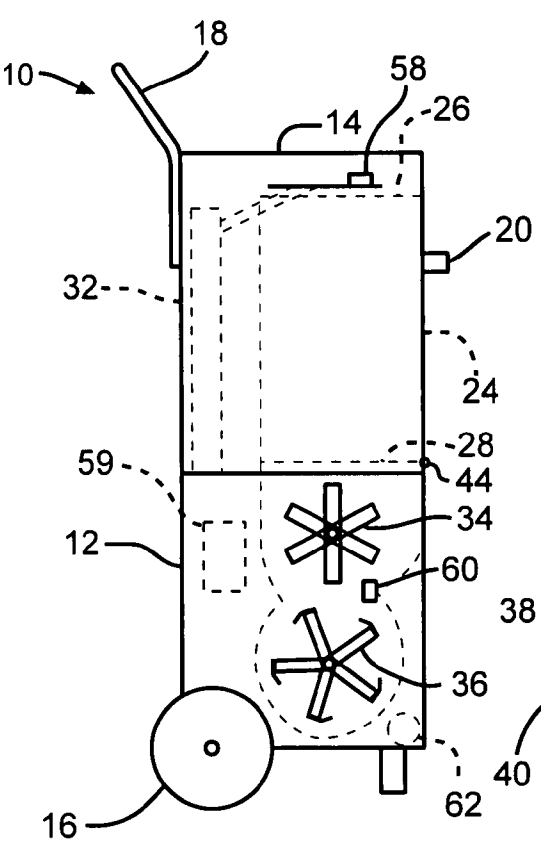
FIG. 1 is a side view in elevation, partially in cross-section, of an insulation blowing wool machine.
Figure 6:
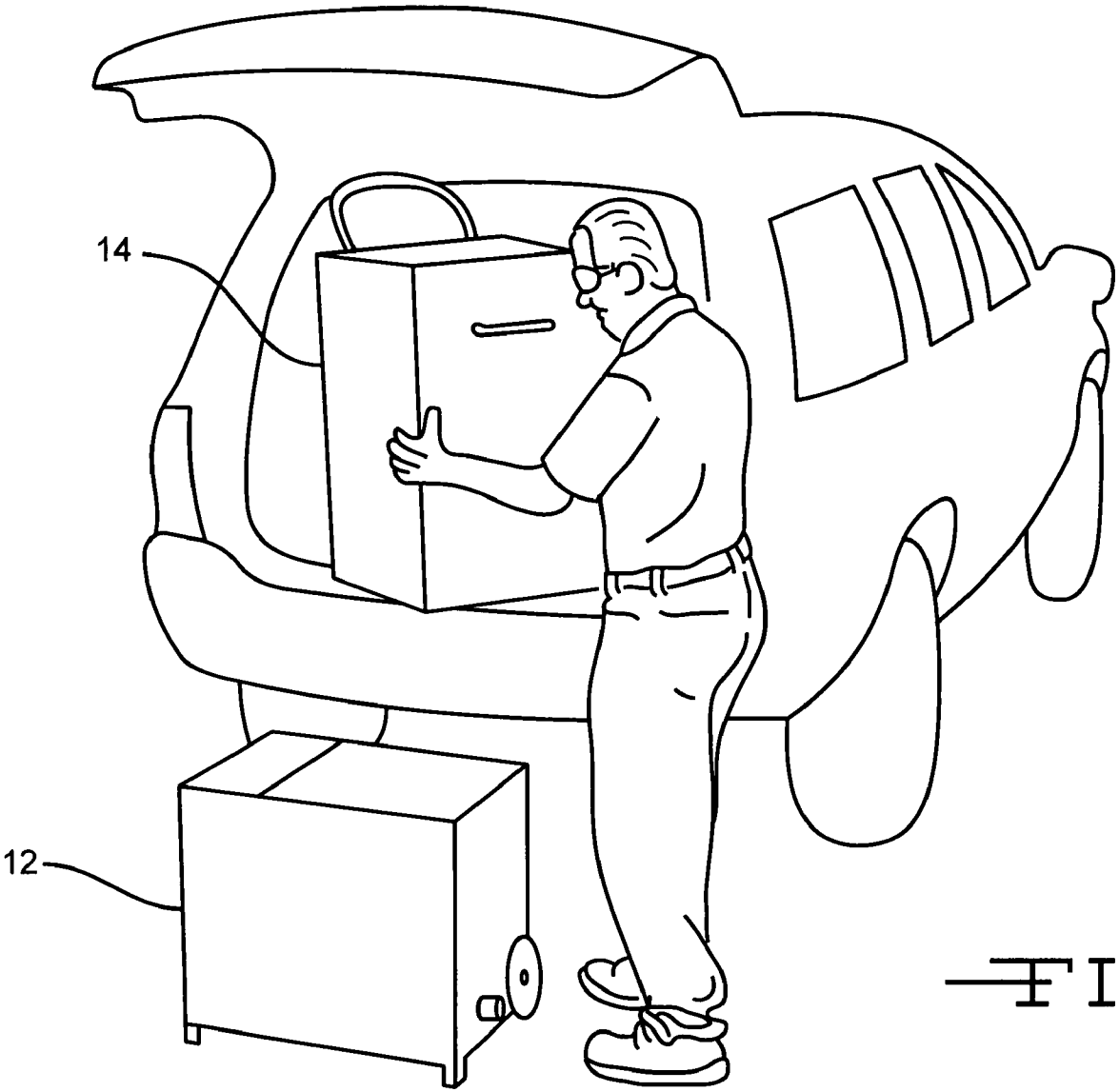
FIG. 6 illustrates the insulation blowing wool machine, separated into upper and lower units, which can be readily loaded into a personal vehicle.

The description and drawings disclose a blowing wool machine 10 for distributing blowing wool from a bag of compressed blowing wool. As shown in FIGS. 1-3, the blowing wool machine 10 includes a lower unit 12 and an upper unit 14. The lower unit 12 and the upper unit 14 are configured to be readily assembled and disassembled to each other for ease of transport in a personal vehicle as shown in FIG. 6. Assembly can be accomplished by the use of fastening mechanisms, not shown, such as clamps, clips, or bolts or any other mechanism suitable to allow easy disassembly and assembly. Additionally, the lower unit 12 and the upper unit 14 optionally can be configured for assembly and disassembly without the use of tools or by the use of simple hand tools such as a wrench, screwdriver or socket set.

The blowing wool machine 10 includes wheels 16 and a machine handle 18 which allow the machine 10 to be moved from one location to another with relative ease. However, the wheels 16 and the machine handle 18 are optional and are not necessary to the operation of the machine 10. As further shown in FIGS. 1-3, the blowing wool machine 10 also includes a chute 24 having an inlet end 26 and an outlet end 28. The chute 24 is configured to receive a bag 30 of compressed blowing wool. A ram assembly 32 is configured to drive the blowing wool from the bag 30 while maintaining the bag in place in the chute. A shredder 34 is mounted at the outlet end 28 of the chute 24 for shredding the compressed blowing wool as it is driven from the bag 30. The shredder 34 can be any means to separate the wool from the body of compressed blowing wool. A rotary valve 36 is positioned downstream from the shredder 34 to distribute the shredded blowing wool into an airstream. A blower 62 is mounted in the lower unit 12 to provide an airstream necessary to drive the shredded blowing wool through the rotary valve 36 and through the machine outlet 22. The shredder 34 and rotary valve 36 are both mounted for rotation. They can be rotatably driven by any suitable means, such as by a motor 38, a gearbox 40 and belts and pulleys 42 as shown in FIG. 2.

Alternatively, the shredder 34 and rotary valve 36 can be provided with their own motor. In this embodiment, the chute 24 has a rectangular cross-sectional shape that approximates the cross-sectional shape of the bag 30 of compressed blowing wool. Alternatively, the chute 24 may have a round cross-sectional shape that approximates the cross-sectional shape of a package of blowing wool in roll form or any other cross-sectional shape that approximates the cross-sectional shape of the package of compressed blowing wool.

As further shown in FIG. 2, the chute handle 20 is connected to the chute 24 and is used to open the chute 24 by pivoting the chute 24 about a chute pivot axis 44 into an open chute position, 24*a* as shown in FIG. 3. The chute 24 is subsequently closed as the chute handle 20 is used to pivot the chute 24 about the chute pivot axis 44 to a closed position. In the closed position, the chute 24 is configured to align with the ram assembly 32. Alignment of the chute 24 with the ram assembly 32, allows the chute 24 to guide the ram assembly 32 as the ram assembly 32 travels substantially along the length of the chute 24 to drive the compressed blowing wool from the bag 30 toward the shredder 34.

The bag 30 of compressed blowing wool is securely held in the chute 24 by a gripping assembly 46 as shown in FIG. 3. The gripping assembly 46 allows the ram assembly 32 to drive the compressed blowing wool through the bag 30 and through the outlet end 28 of the chute 24 and into the shredder 34 while maintaining the bag 30 in a relatively fixed position with respect to the chute 24. The gripping assembly 46 engages the bag 30 of compressed blowing wool as the bag 30 is opened in the chute 24 and the compressed blowing wool expands within the chute 24. The secure engagement of the bag 30 by the gripping assembly 46 prevents the bag 30 from being driven into the shredder 34 by the ram assembly 32. In this embodiment of the blowing wool machine 10, the gripping assembly 46 includes a series of pins on opposite sides of the chute 24. Alternatively, the gripping assembly 46 can be any means of grabbing and securing the bag 30 of compressed blowing wool while maintaining the bag 30 in a relatively fixed position with respect to the chute 24. Examples of mechanisms that can be used for the gripping assembly 46 include clamps, pins, clips, hooks, serrated portions, and fixtures. Any other suitable means can be used.

Figure 4:
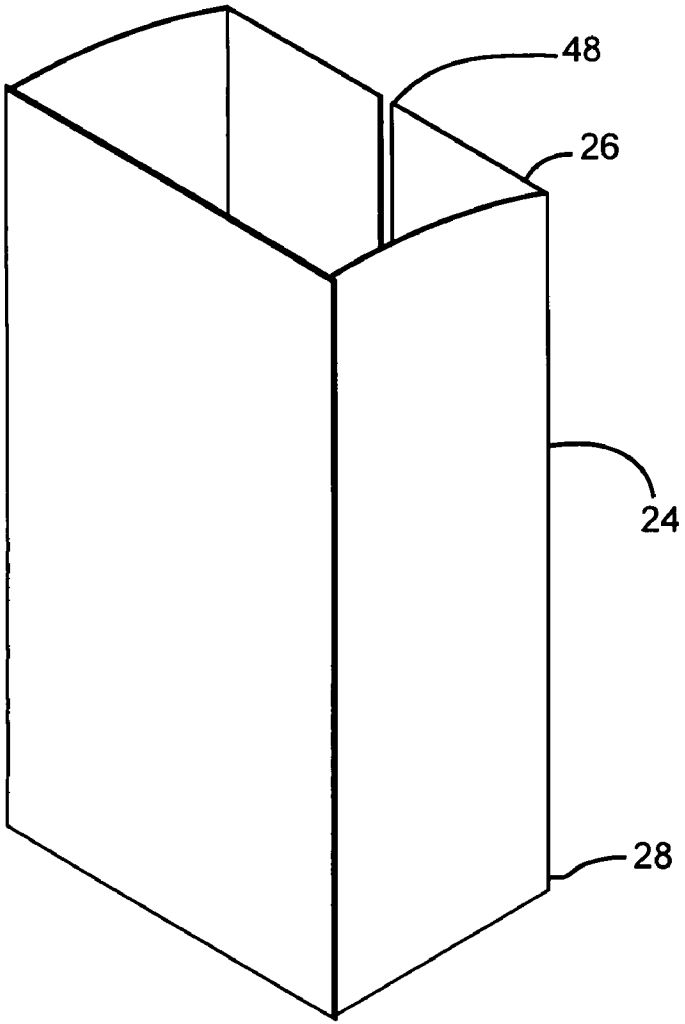
FIG. 4 is a perspective view of the chute.

As shown in FIG. 4, a slot 48 extends from the inlet end 26 of the chute 24 toward the outlet end 28 of the chute 24. The slot 48 is configured to guide the ram assembly 32 as it drives the compressed blowing wool from the bag 30 toward the outlet end 28 of the chute 24.

Figure 5:
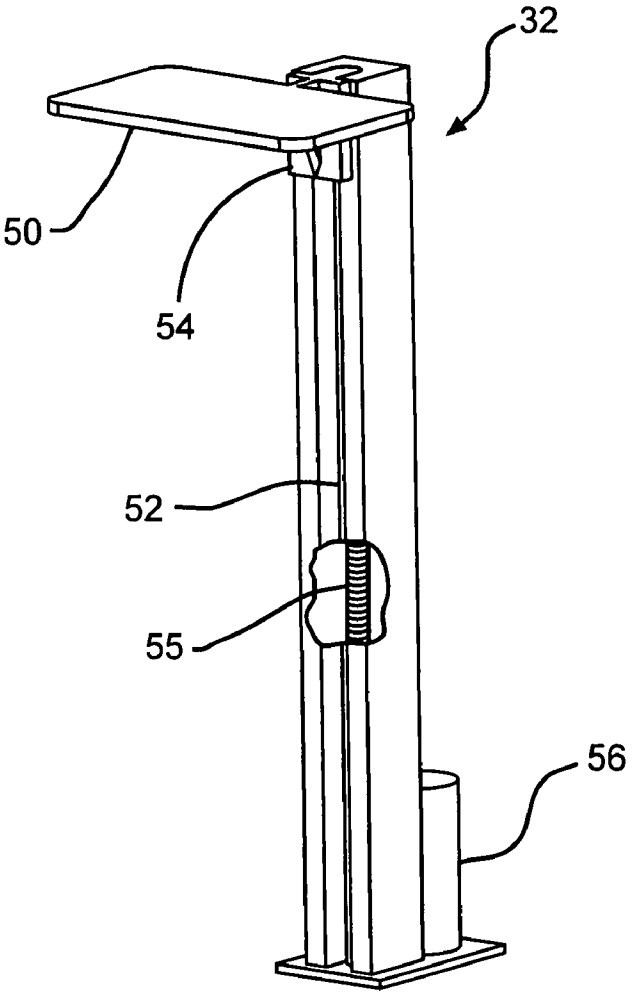
FIG. 5 is a perspective view of the ram assembly.

Referring to FIG. 5, the ram assembly 32 includes a ram member 50 configured to contact and drive the blowing wool through the bag 30. A ram mover 52 is configured to support the ram member 50 and a carriage 54, and to move them substantially along the length of the chute 24. In this embodiment, the ram member 50 is a solid plate, but, the ram member 50 can be a frame, a mesh framework, a framework including structural projections or any other device suitable for contacting and driving the blowing wool from the bag 30. The ram member 50 is connected to the carriage 54. The carriage 54 connects the ram member 50 to the ram mover 52 and is configured such that the ram mover 52 pulls the carriage 54 and the ram member 50 along the chute 24 toward the outlet end 28 of the chute 24 while being guided by the slot 48. As the ram member 50 moves along the slot 48, it drives the compressed blowing wool from the bag 30.

In the embodiment shown in FIG. 5, the ram mover 52 is comprised of a rotating screw 55, positioned within the ram mover 52. The carriage 54 is connected to the rotating screw 55 and is configured to advance as it follows the rotation of the rotating screw 55. Alternatively, the ram mover 52 can be any means of driving the carriage 54 and the connected ram member 50 along the chute 24, including an induction coil system, a hydraulic system, a pneumatic system, a drive chain system, or a jackscrew system.

The carriage 54 is configured to be guided by the slot 48 in the chute 24 when the chute 24 is in the closed position. The ram mover 52 is connected to a ram actuator 56, which moves the ram mover 52. In the embodiment shown in FIG. 5, the ram actuator 56 is an electric motor connected to the screw 55, but the ram actuator 56 may be any means suitable for moving the ram mover 52. As shown in FIGS. 1-3, the ram assembly 32 is completely contained within the upper unit 14, including those times when the blowing wool machine 10 has a bag 30 of compressed blowing wool in the chute 24 and when the blowing wool machine 10 does not have a bag 30 of compressed blowing wool in the chute 24.

The ram assembly 32 optionally includes a ram assembly sensor 58 as shown in FIGS. 1-3, connected to the ram member 50. The ram assembly sensor 58 determines the force of the ram member 50 against the compressed blowing wool. The ram assembly sensor 58 is connected to a controller 59, which is configured to control the ram assembly 32 in response to a signal from the ram assembly sensor 58. In order to prevent overloading of the blowing wool machine 10, or to prevent excessive volumes of blowing wool from being forced into the shredder 34, the controller 59 can be configured to slow down, stop, or reverse the ram assembly 32 if the sensed pressure is too great. The ram assembly sensor 58 can be any sensor suitable to determine the force of the ram member 50 against the compressed blowing wool. Alternatively, the ram assembly sensor 58 may be connected to any part of the ram assembly 32 that allows the ram assembly sensor 58 to determine the force of the ram member 50 against the compressed blowing wool.

As shown in FIGS. 1-3, the lower unit 12 of the blowing wool machine 10 optionally includes a post-shredding sensor 60 located immediately downstream from the shredder 34. Alternatively, the post-shredding sensor 60 can be located at any point downstream from the shredder 34 including at any point before the rotary valve 36, at any point in the rotary valve 36, or at any point in the machine outlet 22 (downstream from the rotary valve 36). The post-shredding sensor 60 can be configured to determine the pressure of the blowing wool after the blowing wool has been shredded. The post-shredding sensor 60 is connected to the controller 59, which is configured to control the ram assembly 32 in response to a signal from the post-shredding sensor 60. A common problem with blowing wool machines is that the flow of shredded wool is uneven. If too much shredded blowing wool is driven through the machine outlet 22, the outlet 22 or a hose downstream from the outlet 22 can become plugged. In order to prevent too much shredded blowing wool from being driven through the machine 10, the controller 59 can be configured to slow down, stop, or reverse the ram assembly 32 if the sensed pressure is too great. The post-shredding sensor 60 can be any sensor suitable to determine the air pressure or the force of the shredded blowing wool at any location downstream from the shredder 34.

The blowing wool in the bag 30 of compressed blowing wool can be any loosefil insulation, such as a multiplicity of discrete, individual tuffs, cubes, flakes, or nodules. The blowing wool can be made of glass fibers or other mineral fibers, and can be organic fibers or cellulose fibers. The blowing wool can have a binder material applied to it, or can be binderless. The blowing wool in the bag 30 is typically compressed to a ratio of at least 10:1, which means that the unconstrained blowing wool after the bag 30 is opened has a volume of 10 times that of the compressed blowing wool in the bag 30. Other compression ratios higher than 10:1 can be used. In one embodiment, the bag 30 has approximate dimensions of 9 inches high, 19 inches wide and 21 inches long, and weighs approximately 13 pounds. A typical chute 24 for such a bag 30 will have a cross-section of approximately 10 inches high by 20 inches wide and have an approximate length of 23 inches. The bag 30 itself is typically made of a polymeric material, such as polyethylene, although any type of material suitable for maintaining the blowing wool in the desired compression can be used. Preferably, the bag 30 will provide a waterproof barrier against water, dirt and other deleterious effects. By using a polymeric material for the bag 30, the compressed blowing wool will be protected from the elements during transportation and storage of the bag 30. The material used for the bags 30 typically is sufficient to handle the physical abuse to which such bags are frequently subjected.

Figure 8:
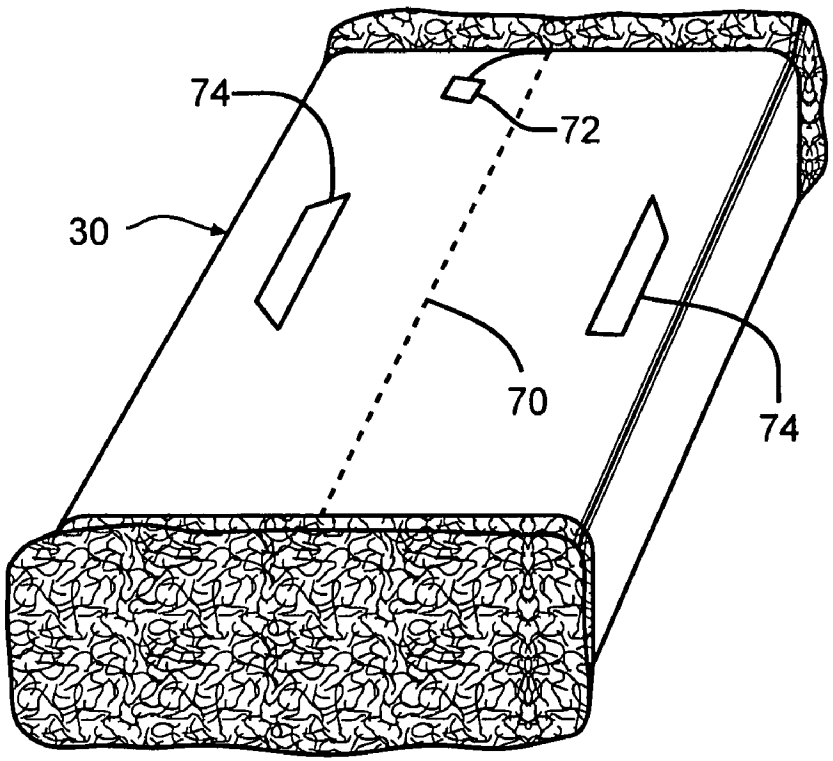
FIG. 8 is a perspective view of a bag of compressed blowing wool with the tear away end portions of the bag removed.
Figure 7:
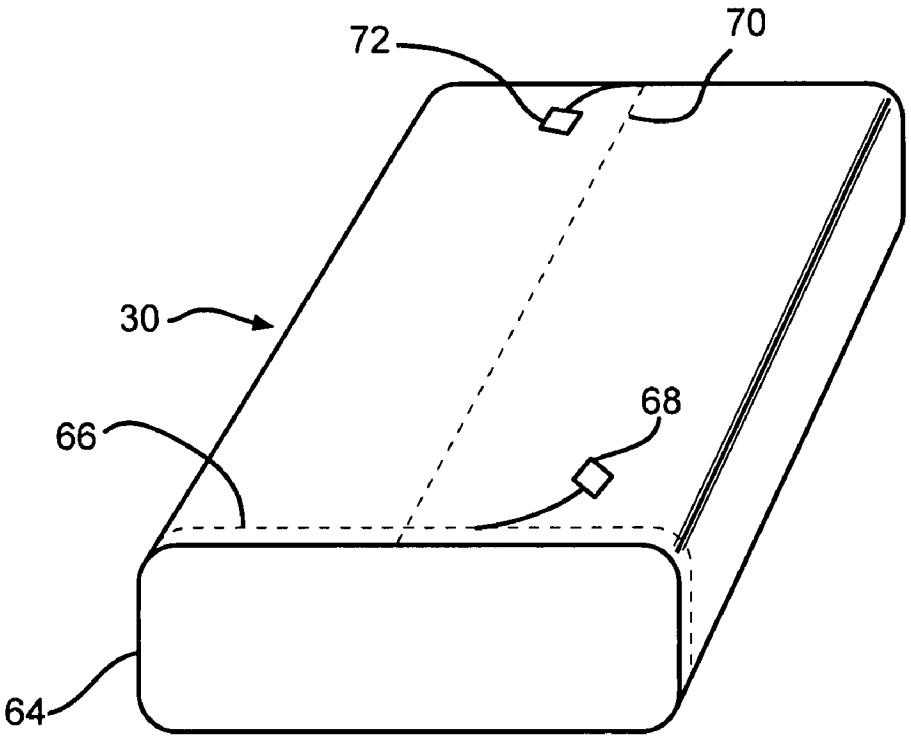
FIG. 7 is a perspective view of a bag of compressed blowing wool.

In order to facilitate shredding of the compressed blowing wool and avoid shredding of the bag 30 as the blowing wool is driven into the shredder 34 by the ram assembly 32, the ends of the bag must be removed before the blowing wool can be distributed. Optionally, the bag 30 has tear away end portions 64, as shown in FIG. 7. In the embodiment shown in FIG. 7, the tear away end portions 64 include a tear away seam 66 and an optional tear away ripcord 68. The tear away seam 66 and the tear away ripcord 68 are configured to allow the user to readily remove the tear away end portions 64 of the bag 30 by hand. Alternatively, the tear away mechanism can be a line of serrations or weakened bag material or any other means of readily removing the tear away end portions 64 of the bag 30 by hand. As shown in FIG. 8, the tear away end portions 64 enable the machine user to readily remove the tear away end portions 64 of the bag 30 prior to loading the bag 30 into the chute 24. The tear away end of the bag 30 can be provided at either end or both ends of the bag 30. It is to be understood that any other method of removing the ends of the bag can be used.

In the embodiment shown in FIGS. 7-8, the bag 30 includes an optional bag seam 70 running substantially the length of the bag. The bag seam 70 is configured to enable the bag 30 to be readily opened by the machine user, by hand, after the bag 30 has been loaded into the chute 24. The bag seam 70 includes an optional bag ripcord 72 that facilitates the opening of the bag 30 by hand after the bag 30 has been loaded into the chute 24. Alternatively, the bag seam 70 may include removable tape or any other means suitable to allow opening of the bag 30 in the chute 24 by hand.

As previously discussed, the blowing wool machine 10 shreds or breaks apart compressed blowing wool that is driven into the shredder 34 by the ram assembly 32. The bag 30 that encapsulates the compressed blowing wool is not shredded and is typically securely held by the gripping assembly 46 after the bag 30 has been opened in the open chute 24*a*. Alternatively, the bag 30 can include an outer surface with a high coefficient of friction configured to contact the interior of the chute 24 as the bag 30 is opened in the open chute 24*a*. The outer surface of the bag 30, having the high coefficient of friction, resists the driving movement of the ram assembly 32 as the blowing wool is driven through the bag 30 and maintains the bag 30 in a relatively fixed position with respect to the chute 24. An effective amount of friction can be achieved with a coefficient of at least 0.4.

Alternatively, as shown in FIG. 8, the bag 30 can include gripping fixtures 74 configured to clip to the interior of the chute 24 when the bag 30 is loaded into the open chute 24*a*. The gripping fixtures 74, when clipped to the interior of the chute 24, are configured to resist the driving movement of the ram assembly 32 as the blowing wool is driven through the bag 30 and to maintain the bag in a relatively fixed position with respect to the chute 24. The gripping fixtures 74 can be hooks, clamps, and pins or any other means suitable to maintain the bag 30 in a relatively fixed position with respect to the chute 24 as the ram assembly 32 drives the blowing wool through the bag 30 into the shredder 34.

In operation, the upper unit 14 and lower unit 12 are assembled to each other using simple hand tools. Using the chute handle 20, the chute 24 is pivoted into the open position 24*a*. A bag 30 of compressed blowing wool is prepared to be loaded into the blowing wool machine 10 by removing the tear away end portions 64 of the bag 30 using the tear away ripcord 68. After using the tear away ripcord 68, the tear away end portions 64 of the bag 30 have been removed and discarded, and the bag 30 is ready to be loaded into the machine 10. The bag 30 is then loaded into the open chute 24*a*. The machine operator opens the bag 30, along the bag seam 70, by hand using the bag ripcord 72 or alternatively by removing the removable tape, not shown, from the bag seam 70. As the bag seam 70 opens, the compressed blowing wool expands and the expanding blowing wool forces the bag 30 into contact with the gripping assembly 46. The gripping assembly 46 securely holds the bag 30. The open chute 24*a* is pivoted into the closed position using the chute handle 20. In its closed position, the chute 24 aligns with the ram assembly 32. The machine operator energizes the actuator 56 which forces the ram mover 52 to pull the carriage 54 and the ram member 50 in the direction of the compressed blowing wool as guided by the slot 48 in the chute 24. The carriage 54 and the ram member 50 continue to be pulled in the direction of the compressed blowing wool until the ram member 50 contacts the compressed blowing wool, at which time the ram assembly 32 drives the compressed blowing wool from the bag 30 and into the shredder 34. The shredder 34 shreds the compressed blowing wool without shredding the bag 30, and the blowing wool is distributed into an airstream through the machine outlet 22 by the rotary valve 36. When the bag 30 of compressed blowing wool is empty, the carriage 54 and the ram member 50 are returned to the top of the upper unit 14. The actuator 56 is de-energized, and the chute 24 is opened to remove the empty bag 30.

During the operation of the blowing wool machine 10, various pressures and forces can be monitored. A sensor 58 can be connected to the ram assembly 32 to determine the force of the ram member 50 against the blowing wool. The sensor 58 is also connected to the controller, which is configured to control the ram assembly 32. If the sensor 58 determines that the force on the ram assembly 32 is excessive, the controller is configured to control the ram assembly 32 accordingly. Similarly, a post-shredding sensor 60 is optionally connected to a convenient point downstream of the shredder 34 to determine the pressure of the blowing wool at that point. The post-shredding sensor 60 is also connected to the controller, which is configured control the ram assembly 32. If the post-shredding sensor 60 determines that the pressure is excessive, the controller 59 is configured to control the ram assembly 32 accordingly.

The optimal use of the blowing wool machine 10 involves supplying the blowing wool into the chute as a body of compressed blowing wool contained in the bag 30. However, the blowing machine 10 can be supplied with loose blowing wool not contained in a bag to accommodate the situation where the bag 30 has broken open prior be being placed in the chute 24.

Figure 9:
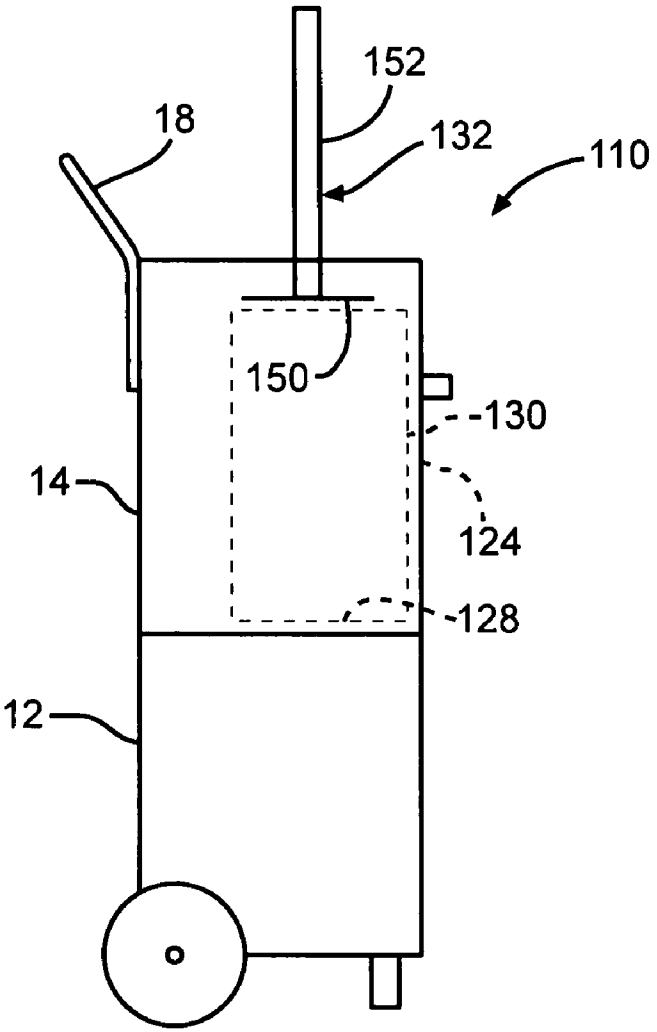
FIG. 9 is a side view in elevation, partially in cross-section, of an insulation blowing wool machine with an optional top down driven ram assembly.

In another embodiment of the blowing wool machine 110, as shown in FIG. 9, an alternative ram assembly 132 is used to drive the compressed blowing wool through the bag 130 and into the shredder, not shown. The ram assembly 132 includes a ram member 150 configured to contact and drive the blowing wool through the bag 130. In this embodiment, the ram member 150 is a solid plate, but the ram member 150 can be a frame, a mesh framework, a framework including structural projections or any other device suitable for contacting and driving the blowing wool from the bag 130. The ram member 150 is connected to a ram mover 152. The ram mover 152 is configured to push, not pull, the ram member 150 toward the outlet end 128 of the chute 124. The ram mover 152 can be any means suitable to push the ram member 150 substantially along the length of the chute 124, including an induction coil system, a hydraulic system, a pneumatic system, or a jack-screw system, while maintaining the is bag 30 in a relatively fixed position with respect to the chute 124.

Figure 10:
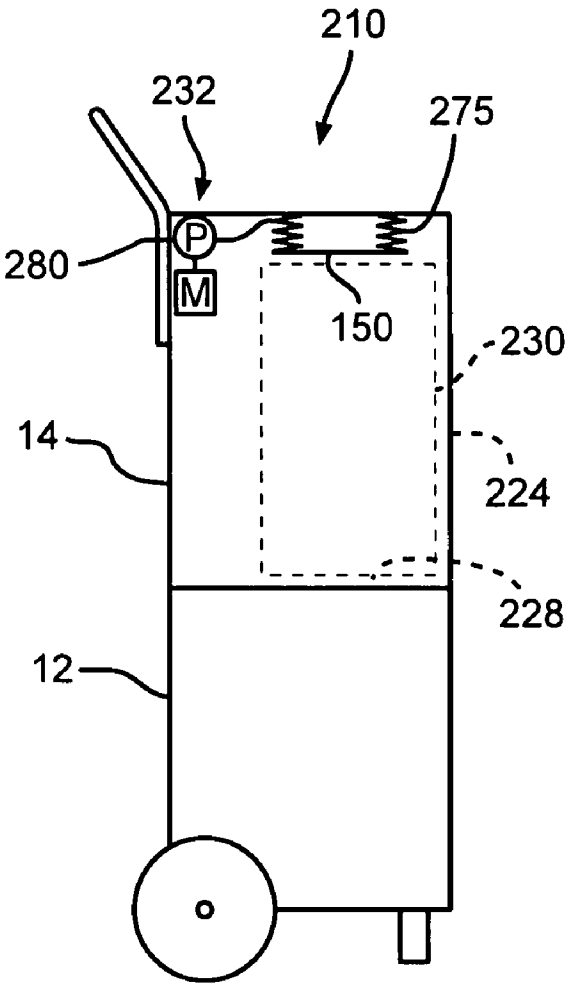
FIG. 10 is a side view in elevation, partially in cross-section, of an insulation blowing wool machine with an optional bladder system for driving the ram member.

In another embodiment of the blowing wool machine 210, as shown in FIG. 10, an alternative ram assembly 232 is used to drive the compressed blowing wool through the bag 230 and into the shredder, not shown. The ram assembly 232 includes a ram member 250 configured to contact and drive the blowing wool through the bag 230. In this embodiment, the ram member 250 is a solid plate, but the ram member 250 can be a frame, a mesh framework, a framework including structural projections or any other device suitable for contacting and driving the blowing wool from the bag 230. The ram member 250 is connected to an inflatable bladder 275, which is configured to push, not pull, the ram member 250 toward the outlet end 228 of the chute 224 while maintaining the bag 230 in a relatively fixed position with respect to the chute 224. The inflatable bladder 275 is supplied by an air system 280. The air system can be any suitable means to supply air to the inflatable bladder 275 including a compressor system or a pneumatic system.

In the present embodiment, as shown in FIGS. 1-3, the machine 10 is operated with the chute 24 in the vertical position. It is to be understood that the machine 10 can be operated with the chute 24 in a position that is not vertical. The chute 24 can be operated in a horizontal position or in any other position that allows the chute 24 to receive a bag 30 of compressed blowing wool and to guide the ram assembly 32 as the ram assembly 32 drives the compressed blowing wool from the bag 30 into the shredder 34.

The principle and mode of operation of this invention have been described in its preferred embodiments. However, it should be noted that this invention may be practiced otherwise than as specifically illustrated and described without departing from its scope.

What is claimed is:

1. A machine for distributing blowing wool from a bag of compressed blowing wool, the machine comprising:

a chute having an inlet end and an outlet end, said chute configured to receive the bag of compressed blowing wool;

a gripping assembly positioned in said chute, said gripping assembly configured to securely hold the bag in said chute;

a ram assembly having a ram member configured to drive the compressed blowing wool through the bag toward said outlet end of said chute while said gripping assembly maintaining the bag in a relatively fixed position with respect to said chute;

a shredder mounted at said outlet end of said chute and configured to pick apart the compressed blowing wool; and a rotary valve for distributing said blowing wool into an airstream, wherein said gripping assembly prevents the bag from being driven into said shredder by said ram member.

2. The machine of claim 1 in which said gripping assembly comprises a series of pins on opposite sides of said chute.

3. The machine of claim 1 in which said ram assembly is configured to pull said ram member toward said outlet end of said chute.

4. The machine of claim 1 in which said ram assembly is an inflatable bladder system including an inflatable bladder and an air system, said inflatable bladder configured to drive the compressed blowing wool from the bag toward said outlet end of said chute while maintaining the bag in a relatively fixed position with respect to said chute.

5. The machine of claim 1 in which the machine comprises an upper unit and a lower unit, said upper unit and said lower unit are configured to be readily assembled and disassembled to each other for ease of transport and use.

6. A machine for distributing blowing wool from a bag of compressed blowing wool, the machine comprising:

an upper unit;

a chute including an inlet end and an outlet end, said chute pivotally mounted in said upper unit and configured to pivot to an open position to receive the bag of compressed blowing wool and subsequently to pivot to a closed position;

a gripping assembly positioned in said chute, said gipping assembly configured to securely hold the bag in said chute;

a ram assembly including a ram member configured to drive the compressed blowing wool through the bag toward said outlet end of said chute while said gripping assembly maintaining the bag in a relatively fixed position with respect to said chute;

a shredder mounted at said outlet end of said chute and configured to pick apart the compressed blowing wool; and a rotary valve for distributing the blowing wool into an airstream;

wherein said chute is configured such that in its closed position said chute is aligned with said ram assembly, and wherein said gripping assembly prevents the bag from being driven into said shredder by said ram member .

7. The machine of claim 6 in which said ram assembly is configured to pull said ram member toward said outlet end of said chute.

8. A machine for distributing blowing wool from a bag of compressed blowing wool, said machine comprising:

a chute including an inlet end and an outlet end, said chute being configured to receive the bag of compressed blowing wool;

a gripping assembly positioned in said chute, said gripping assembly configured to securely hold the bag in said chute;

a ram assembly including a carriage and ram member positioned to drive the compressed blowing wool through the bag toward said outlet end of said chute while said gripping assembly maintaining the bag in a relatively fixed position with respect to said chute;

a slot in said chute extending from said inlet end of said chute and being configured to guide said carriage and said ram member to drive the compressed blowing wool from the bag toward said outlet;

a shredder mounted at said outlet end of said chute and configured to pick apart the compressed blowing wool; and a rotary valve for distributing said blowing wool into an airstream, and wherein said gripping assembly prevents the bag from being driven into said shredder by said ram member.

9. The machine of claim 8 in which said ram assembly is configured to pull said ram member toward said outlet end of said chute.

* * * * *